US009822782B2

(12) United States Patent
McKinzie

(10) Patent No.: US 9,822,782 B2
(45) **Date of Patent: *Nov. 21, 2017**

(54) INTEGRATED AUXILIARY LOAD CONTROL AND METHOD FOR CONTROLLING THE SAME

(71) Applicant: Regal Beloit America, Inc., Beloit, WI (US)

(72) Inventor: Marc C. McKinzie, West Milton, OH (US)

(73) Assignee: Regal Beloit America, Inc., Beloit, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/996,490

(22) Filed: Jan. 15, 2016

(65) Prior Publication Data

US 2016/0131143 A1 May 12, 2016

Related U.S. Application Data

(62) Division of application No. 13/285,524, filed on Oct. 31, 2011, now Pat. No. 9,238,918.

(51) Int. Cl.

| | |
|---|---|
| ***E04H 4/00*** | (2006.01) |
| ***F04D 15/00*** | (2006.01) |
| ***E04H 4/12*** | (2006.01) |
| ***E04H 4/16*** | (2006.01) |
| ***F04D 1/00*** | (2006.01) |
| ***F04D 3/00*** | (2006.01) |

(52) U.S. Cl.

CPC ..... *F04D 15/0066* (2013.01); *E04H 4/12* (2013.01); *E04H 4/129* (2013.01); *E04H 4/1281* (2013.01); *E04H 4/1672* (2013.01); *F04D 1/00* (2013.01); *F04D 3/005* (2013.01); *Y10T 137/0318* (2015.04); *Y10T 137/8158* (2015.04)

(58) Field of Classification Search

CPC ..... A63B 69/125
USPC ..... 4/488–513
See application file for complete search history.

(56) References Cited

U.S. PATENT DOCUMENTS

| | | | |
|---|---|---|---|
| 7,686,589 | B2 | 3/2010 | Stiles, Jr. et al. |
| 7,777,435 | B2 | 8/2010 | Aguilar et al. |
| 7,854,597 | B2 | 12/2010 | Stiles, Jr. et al. |
| 2008/0247880 | A1 | 10/2008 | Leuthen et al. |
| 2010/0247332 | A1 | 9/2010 | Stiles, Jr. et al. |
| 2016/0131143 | A1 | 5/2016 | McKinzie |

FOREIGN PATENT DOCUMENTS

| | | |
|---|---|---|
| EP | 1639984 | 3/2006 |
| EP | 2273125 | 1/2011 |

*Primary Examiner* — Lori Baker
(74) *Attorney, Agent, or Firm* — Michael Best & Friedrich LLP

(57) ABSTRACT

A method of controlling a liquid movement system, such as a pool system. The method includes receiving a maximum time that an auxiliary load is to operate, receiving a minimum pump speed of a pump system that pumps a liquid through the auxiliary load, monitoring the time that an auxiliary load has been in operation, monitoring the pump speed of a pump system that pumps a liquid through the auxiliary load, and deactivating the auxiliary load if the maximum time or minimum pump speed has been met. Also disclosed are a pool system and a controller for controlling the pool system.

10 Claims, 6 Drawing Sheets

INTEGRATED AUXILIARY LOAD CONTROL AND METHOD FOR CONTROLLING THE SAME

CROSS-REFERENCE TO RELATED APPLICATIONS

This application is a divisional of U.S. patent application Ser. No. 13/285,524, filed Oct. 31, 2011, now U.S. Pat. No. 9,238,918. This application is incorporated herein by reference in its entirety.

BACKGROUND

The invention relates to a system (such as a pool system) controlled in part by a motor (such as a motor-powered pump controlling the pool system).

Pool systems (e.g., swimming pools, hot tubs, spas, whirlpools, jetted tubs, clothes washing machines, and similar apparatuses) typically have auxiliary loads connected to the system that perform different tasks. These task range from heating the fluid within the pool system to sanitizing the fluid within the pool system. These auxiliary loads often require a minimum flow rate of the fluid flowing though them. If the minimum flow rate is not met and the auxiliary load is still operating, then the auxiliary load will not function properly or can be damaged. Therefore, many pump systems for pool systems continually pump the fluid at a rate high enough to meet the minimum flow rate of the auxiliary load connected to the pool system or have sensors within each auxiliary load of the pool system to deactivate the auxiliary load if the minimum flow rate is not met.

SUMMARY

It has been determined that continually having the flow of fluid at a rate high enough to prevent auxiliary load damage or incorrect functionality wastes energy. Further, having sensors within each auxiliary load is costly for the auxiliary load manufacturers.

In one embodiment, the invention provides a pool system for controlling an auxiliary load. The pool system includes a vessel to hold a fluid, an auxiliary load, and a pump system coupled to the vessel and the auxiliary load. The pump system pumps the fluid through the auxiliary load. The pump system includes a motor, and a fluid pump powered by the motor, and a controller. The controller controls a pump speed of the pump system, and a power source to the auxiliary load.

In another embodiment the invention provides a control system for controlling a liquid movement system. The control system includes a controller electrically connected to a motor. The controller controls the speed of the motor. The controller is further electrically connected to an auxiliary load. The controller controls the activation of the auxiliary load based on an inputted maximum time that the auxiliary load is to be activated, and an inputted minimum speed of the motor that the auxiliary load is to be activated at.

In yet another embodiment, the invention provides a method of controlling a liquid movement system. The method includes receiving a maximum time requirement that an auxiliary load is to operate, receiving a minimum pump speed requirement of a pump system that pumps a liquid through the auxiliary load, monitoring the time that an auxiliary load has been in operation, monitoring the pump speed of a pump system that pumps a liquid through the auxiliary load, and deactivating the auxiliary load if the maximum time requirement or minimum pump speed requirement has been met.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other constructions and of being practiced or of being carried out in various ways.

Figure 1:
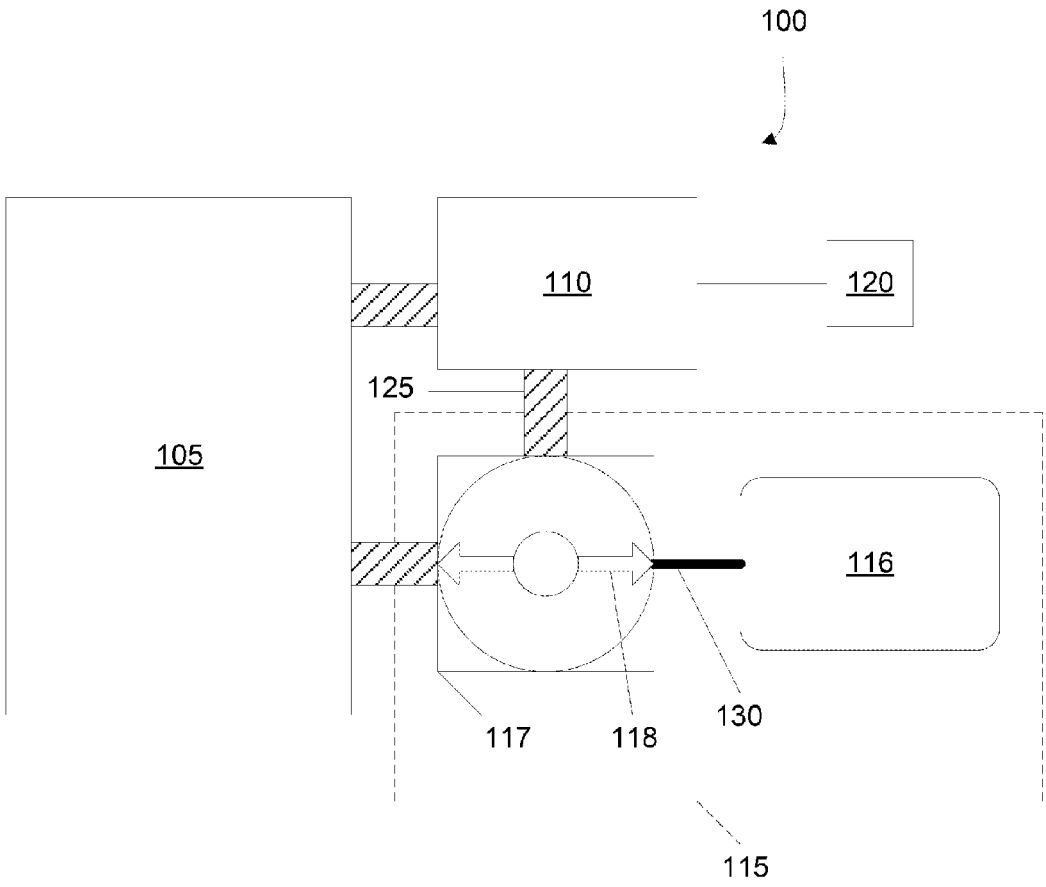
FIG. 1 is a schematic diagram of a pool system.

A pool system 100 embodying the invention is schematically shown in FIG. 1. The pool system 100 generally includes a vessel 105, an auxiliary load 110, a pump system 115, and a controller 120. The pump system 115 generally includes a motor 116, a fluid pump 117 coupled to the motor 116, and a fluid agitator 118 located within the fluid pump 117.

In the preferred construction, the vessel 105 is a hollow container such as a tub, pool, or vat that holds a fluid. The fluid can be any type of fluid. In one construction the fluid is chlorinated water.

As shown in FIG. 1, the auxiliary load 110 is connected in line with the vessel 105 and pump system 115 by a piping system 125. The auxiliary load 110 can be a type of pool equipment that receives the fluid originating from the vessel 105 in response to the pump system 115 moving the fluid. In one construction, the auxiliary load 110 is a pool heater used to heat the fluid contained within the vessel 105 and pumped by the pump system 115 through the pool heater. In another construction, the auxiliary load 110 is a saltwater chlorinator used to sanitize the fluid contained within the vessel 105 and pumped by the pump system 115 through the saltwater chlorinator. In another construction, the auxiliary load 110 is a booster pump used to operate a cleaning device within the vessel 105 and pumped by the pump system 115 through the booster pump. In another construction, the auxiliary load 110 is a pool cleaner which is used to clean the bottom of the vessel 105, and has the fluid from the vessel 105 pumped through the pool cleaner by the pump system 115. In another construction, the auxiliary load 110 is a solar heater which is used to heat the fluid contained within the vessel 105 and pump by the pump system 115 through the solar heater. In another construction, the auxiliary load 110 is a set of lights and does not receive fluid originating from the vessel 105.

Figure 1A:
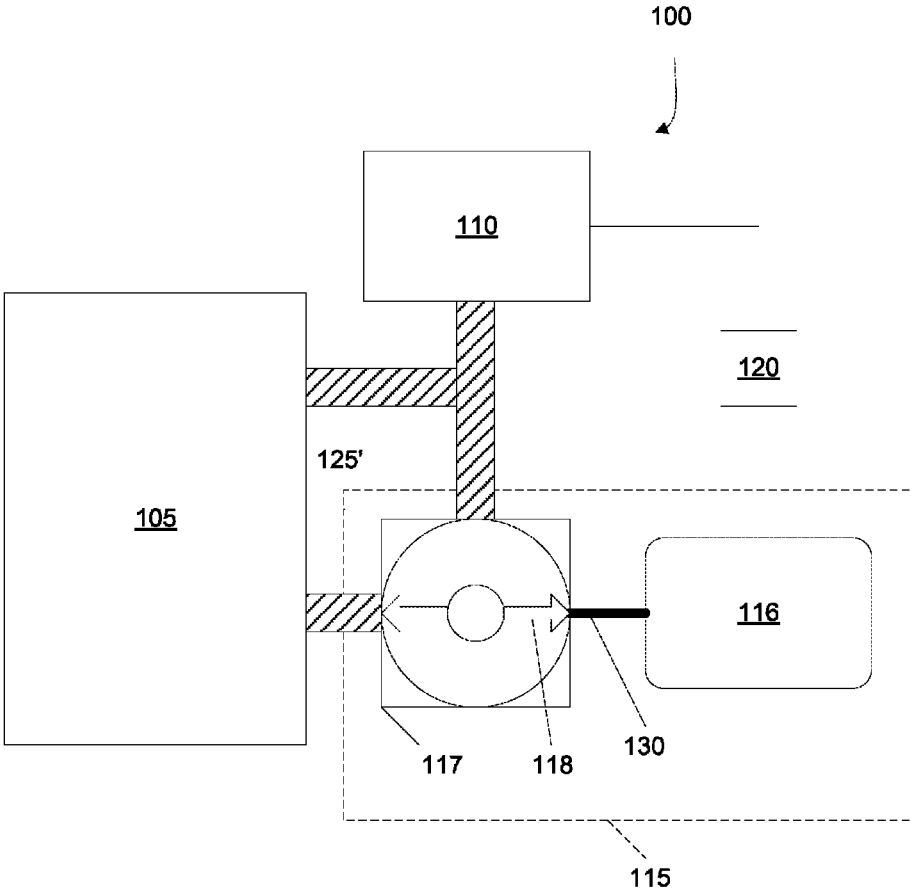
FIG. 1*a* is a schematic diagram of another construction of a pool system.

FIG. 1*a* shows another construction of the pool system 100. In FIG. 1*a*, the auxiliary load 110 connected to the vessel 105 and the pump system 115 with a T-shaped piping system 125', rather than connected in line with the vessel 105 and the pump system 125.

As shown in FIG. 1, the pump system 115 is connected in line with the vessel 105 and the auxiliary load 110 by the piping system 125. The pump system 115 is used to pump the fluid contained within the vessel 105 through the auxiliary load 110. The pump system 115 contains a motor 116, a fluid pump 117, and a fluid agitator 118. As is known, the motor 116 takes electrical energy and converts the electrical energy into mechanical energy. The motor 116 can be, for example, a direct-current motor or an alternating-current motor. The motor 116 can also be a single-speed motor, a multi-speed motor, or a variable-speed motor. In one exemplary construction, the motor 116 is a permanent magnet, brushless direct-current (BLDC) motor. As is commonly known, BLDC motors include a stator, a permanent magnet rotor, and an electronic commutator. The electronic commutator typically includes, among other things, a programmable device (a microcontroller, a digital signal processor, or a similar controller) having a processor and memory. The programmable device of the BLDC motor uses software stored in the memory to control the electronic commutator. The electronic commutator then provides the appropriate electrical energy to the stator in order to rotate the permanent magnet rotor at a desired speed.

The motor 116 is coupled to the fluid pump 117 by a shaft 130. The fluid pump 117 contains a fluid agitator 118. In one construction, the fluid agitator 118 is an impeller that controllably moves the fluid contained by the vessel 105 through the auxiliary load 115. Other pump systems having other fluid agitators may be used without departing from the spirit of the invention.

As shown in FIG. 1, the controller 120 is electrically coupled to the auxiliary load 110 and the motor 116 of the pump system 115. The controller 120 controls the pump speed of the pump system 115 and the activation or deactivation of the auxiliary load 110. The controller 120 controls the auxiliary load 110 and the pump system 115 based on user inputs. In one construction, the controller 120 is the same controller already contained within the motor 116, therefore having one controller that both directly controls the speed of the motor 116 and the activation of the auxiliary load 110. In another construction, the controller 120 is a separate controller from the controller contained within the motor 116 and controls the auxiliary load 110 while controlling the controller contained within the motor 116, therefore having two separate controllers. An exemplary controller 120 and motor 116 combination is described in U.S. patent application Ser. No. 13/285,624, filed on even date herewith, the entire content of which is incorporated herein by reference.

One user input that the controller 120 uses to determine activation or deactivation of the auxiliary load 110 is a user-inputted minimum pump speed of the pump system 115 that the auxiliary 110 can be active at. Different auxiliary loads have different minimum flow rates for the fluid that flows through them. If the flow rate falls below the minimum while the auxiliary load 110 is activated, then the auxiliary load 110 can be damaged or not function properly. The flow rate through the auxiliary load 110 is related to the pump speed of the pump system 115. Therefore, to prevent damage to the auxiliary load 110, a user inputs a minimum pump speed of the pump system 115. Once the pump speed of the pump system 115 falls below the user-inputted minimum pump speed, the controller 120 automatically deactivates the auxiliary load 110, preventing any possible damage that may be done to the auxiliary load 110.

Another user input that the controller 120 uses to determine activation or deactivation of the auxiliary load 110 is a user-inputted maximum time that the auxiliary load 110 is to be activated. Once the user-inputted maximum time is met, the controller 120 deactivates the auxiliary load 110. In one construction, the user-inputted maximum time is based on a twenty-four hour period. Thus, if for example, a user inputs two hours as the maximum time for the auxiliary load 110 to be activated, the auxiliary load 110 runs for a maximum of two hours every twenty-four hours.

In another construction, the controller 120 uses a user-inputted maximum pump speed of the pump system 115 that the auxiliary load 110 can be active at. Once the pump speed of the pump system 115 is above the user-inputted maximum pump speed, the controller 120 automatically deactivates the auxiliary load 110.

In another construction, the controller 120 uses a user-inputted minimum time that the auxiliary load 110 is to be activated. For example, the controller 120 controls the pump system 115 to operate at the minimum pump speed that the auxiliary load 110 can be active at and activates the auxiliary load 110 for at least the user-inputted minimum time. This ensures that no matter how the normal pump schedule is set the auxiliary load 110 will at least be active for the user-inputted minimum time.

In another construction, the auxiliary load 110 is a load that does not receive fluid originating from the vessel 105, but is still controlled by the controller 120. For example, the auxiliary load 110 is a set of lights which are controlled by the controller 110 to be activated for a user-inputted minimum or maximum amount of time.

Figure 2:
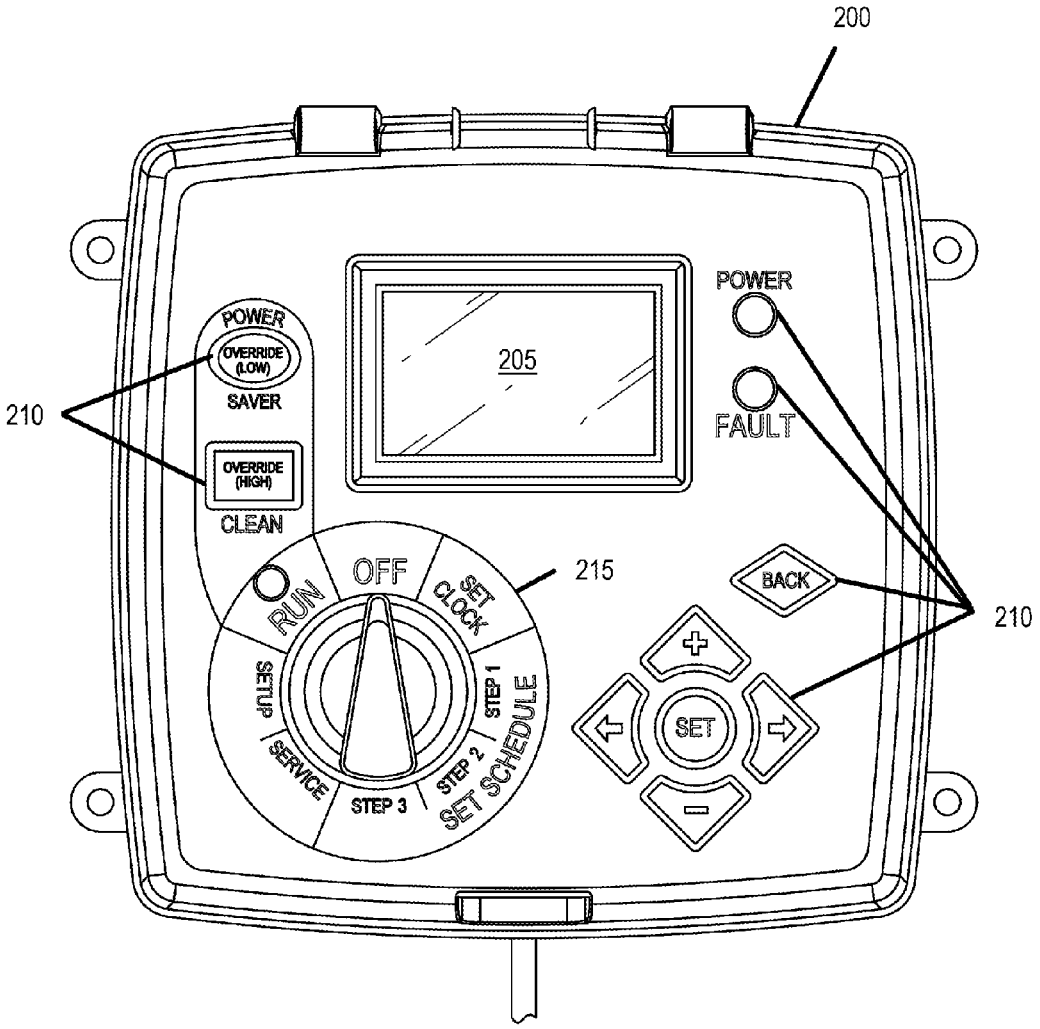
FIG. 2 is a schematic diagram of a user interface of a controller of the pool system shown in FIG. 1.

The controller 120 further includes a user interface 200, as illustrated in FIG. 2. The user interface 200 includes a display screen 205, push buttons 210, and a control knob 215. The display screen 205, push buttons 210, and control knob 215 allow the user to input the minimum pump speed, the maximum pump speed, the maximum time, and the minimum time. The user interface 200 can further include an audio output.

Figure 3:
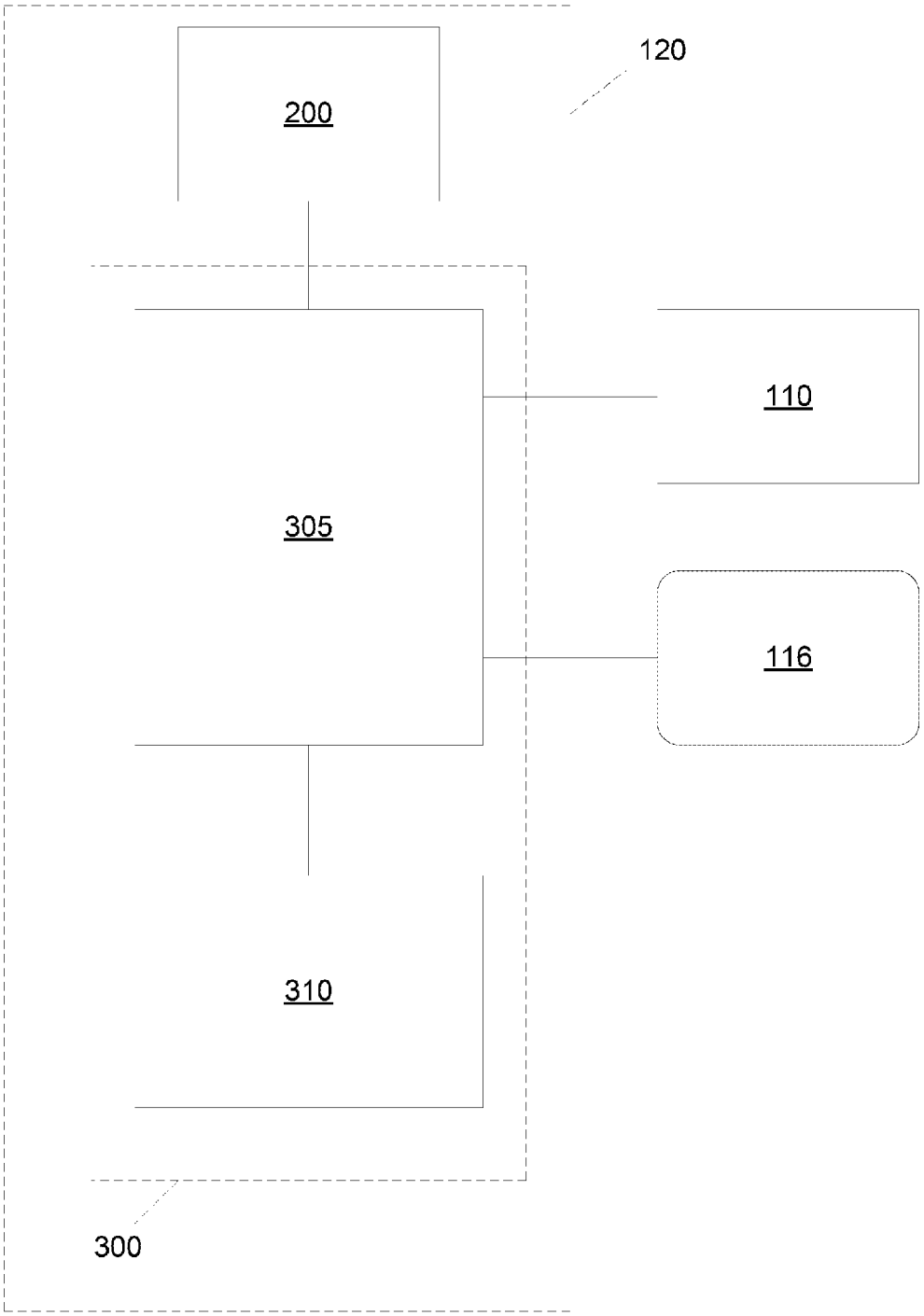
FIG. 3 is a schematic diagram of the controller of the pool system shown in FIG. 1.

As shown in FIG. 3, the controller 120 further includes a microcontroller 300 having a processor 305 and memory 310. The processor 305 of the controller 120 receives an input from the user interface 200. The processor 305 then executes a software program, stored in the memory 310, for analyzing the received signal, and generates one or more control signals that control the activation of the auxiliary load 110 and the motor 116 of the pump system 115. In one construction, the controller 120 includes a relay switch to activate or deactivate the auxiliary load 110 and an internal clock to measure time.

Figure 4:
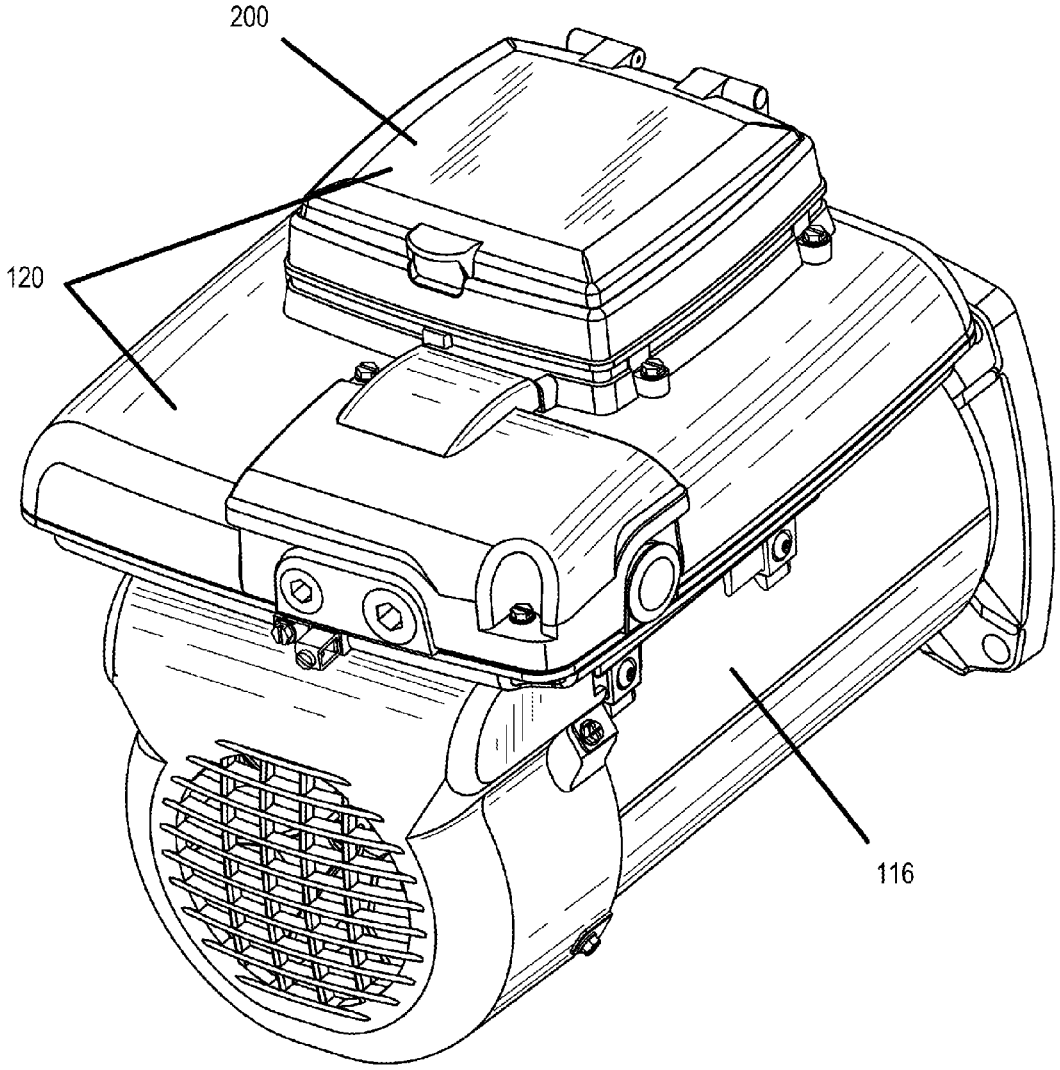
FIG. 4 is a perspective view of the motor, controller, and user interface of the controller of the pool system shown in FIG. 1.

FIG. 4 shows a perspective view of one construction of the motor 116, the controller 120, and the user interface 200 of the controller 120.

Figure 5:
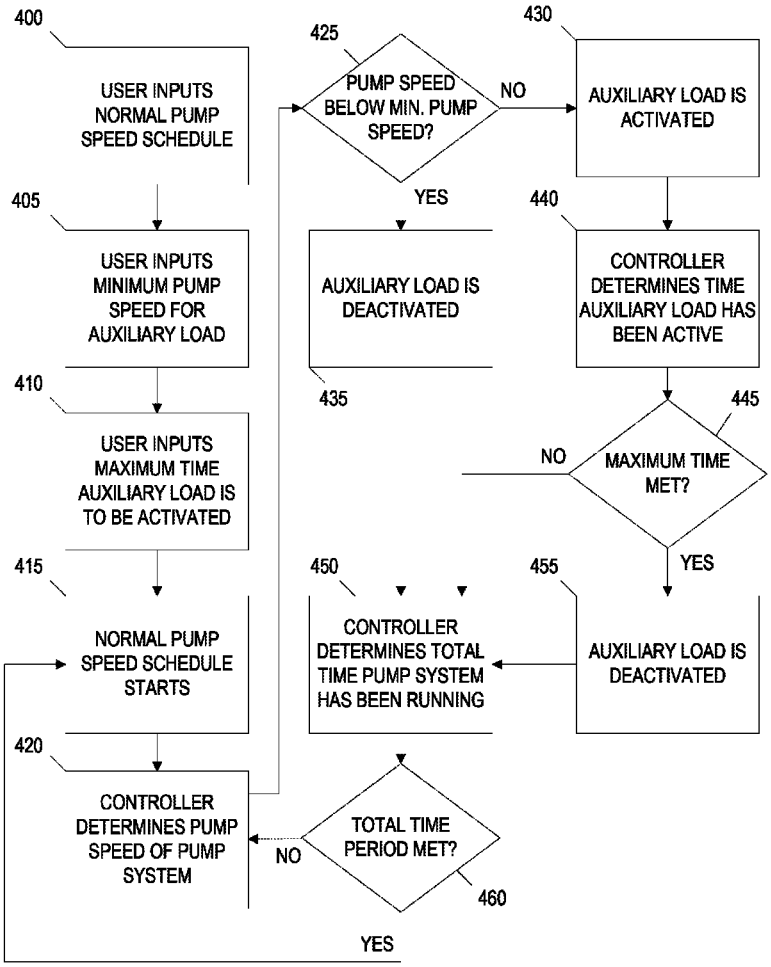
FIG. 5 is a flowchart implementing a method of controlling a pool system with an integrated auxiliary load control.

In one operation and as shown in FIG. 5, the user first inputs a normal pump speed schedule 400 using the user interface 200 of the controller 120. In one construction, where the motor 116 of the pump system 115 is a variable-speed motor, the normal pump speed schedule is a schedule of the pump system 115 operating at different pump speeds. In another construction, where the motor 116 of the pump system 115 is a single-speed motor, the normal pump speed schedule is a schedule of when the pump system 115 is activated or deactivated. In some constructions, the normal pump speed schedule is based on a twenty-four hour period.

The user then inputs a minimum pump speed at act 405 using the user interface 200 of the controller 120. The user then inputs a maximum time that the auxiliary load 110 is to be activated at act 410 using the user interface 200 of the controller 120.

At act 415, the controller 120 starts the normal pump speed schedule that was inputted by the user at act 400. While running the normal pump speed schedule, the controller 120 continually checks if the user-inputted minimum pump speed for the auxiliary load 110 and the user-inputted maximum time the auxiliary load 110 is to be activated has been met. When referring to the controller 120 performing an operation, the processor executes one or more instructions of the software to perform the operation. This may result in the process controlling one or more aspects of the controller 120 or the system either directly or indirectly.

At act 420, the controller 120 determines the pump speed of the pump system 115. For example, at act 425, the controller 120 determines if the calculated pump speed of the pump system 115 is less than or greater than the user-inputted minimum pump speed. If the calculated pump speed of the pump system 115 is greater than the user-inputted minimum pump speed then the operation proceeds to act 430 where the auxiliary load 110 is activated. If the calculated pump speed of the pump system 115 is less than the user-inputted minimum pump speed then the operation proceeds to act 435 where the auxiliary load 110 is deactivated if it is not already.

If the auxiliary load 110 is activated at act 430 then the operation proceeds to act 440 where the controller 120 determines the time that the auxiliary load 110 has been active. At act 445, the controller 120 determines if the determined time is less than or greater than the user-inputted maximum time the auxiliary load 110 is to be active. If the determined time is less than the user-inputted maximum time, then the operation proceeds to act 450. If the calculated time is greater than the user-inputted maximum time, then the operation proceeds to act 455. At act 455 the auxiliary load is deactivated.

At act 450 the controller 120 determines the total time the pool system 100 has been operating. The operation then proceeds to act 460. At act 460, the controller 120 determines if the total time period that the pump system 115 operates has been met. In one construction, the total time period is twenty-four hours. If the total time period of the pump system 115 has been met, the operation then proceeds back to act 415, which restarts the normal pump schedule again. If the total time period of the pump system 115 has not been met then the operation proceeds back to act 420, where the controller 120 once again checks if the minimum pump speed has been met and if the maximum time has been met, activating or deactivating the auxiliary load 110 as necessary.

Thus, the invention provides, among other things, a new and useful pool system for controlling an auxiliary load. Various features and advantages of the invention are set forth in the following claims.

What is claimed is:

1. A control system for controlling a liquid movement system, the control system comprising:

a controller electrically connected to a motor, the controller controlling a speed of the motor;

the controller electrically connected to an auxiliary load, the controller controlling the activation of the auxiliary load based on an inputted maximum time that the auxiliary load is to be activated, and an inputted minimum speed of the motor that the auxiliary load is to be activated at.

2. A control system as set forth in claim 1 wherein the controller includes a processor to receive the inputted maximum time and the inputted minimum speed and generates one or more control signals to control the auxiliary load and the motor.

3. A control system as set forth in claim 1 wherein the controller includes a user interface to receive the inputted maximum time and the inputted minimum speed, the user interface includes at least one of a display screen, one or more push buttons, or a control knob.

4. A method of controlling a liquid movement system, the method comprising:

receiving a maximum time requirement that an auxiliary load is to operate, receiving a minimum pump speed requirement of a pump system that pumps a liquid through the auxiliary load, monitoring the time that an auxiliary load has been in operation, monitoring the pump speed of a pump system that pumps a liquid through the auxiliary load, and deactivating the auxiliary load if the maximum time requirement or minimum pump speed requirement has been met.

5. A method as set forth in claim 4 wherein the method is performed by a controller containing a processor, memory, and a user interface, the user interface includes at least one of a display screen, one or more push buttons, or a control knob.

6. A method as set forth in claim 4 wherein the method is based on a repetitive time period.

7. A method as set forth in claim 4 wherein the act of receiving the maximum time that an auxiliary load is to operate is measured by a timer.

8. A method as set forth in claim 4 wherein the act of deactivating the auxiliary load is performed by a relay switch.

9. A method as set forth in claim 4 wherein the method uses an auxiliary load which includes at least one of a pool heater, a saltwater chlorinator, a booster pump, a pool cleaner, a solar heater, or lights.

10. A method as set forth in claim 4 wherein the method uses a pump system which includes at least one of a variable-speed motor, a multi-speed motor, or a single-speed motor.

* * * * *